US009085155B2

(12) United States Patent
Ikeda

(10) Patent No.: US 9,085,155 B2
(45) Date of Patent: Jul. 21, 2015

(54) CAP DEVICE AND LIQUID JETTING APPARATUS PROVIDED WITH THE SAME

(71) Applicant: Ayumu Ikeda, Nagoya (JP)

(72) Inventor: Ayumu Ikeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/095,762

(22) Filed: Dec. 3, 2013

(65) Prior Publication Data

US 2014/0085375 A1 Mar. 27, 2014

Related U.S. Application Data

(63) Continuation of application No. 13/073,526, filed on Mar. 28, 2011, now Pat. No. 8,678,546.

(30) Foreign Application Priority Data

Apr. 30, 2010 (JP) ..... 2010-104770

(51) Int. Cl.
*B41J 2/165* (2006.01)
*B41J 2/175* (2006.01)

(52) U.S. Cl.
CPC ..... *B41J 2/16505* (2013.01); *B41J 2/16511* (2013.01); *B41J 2/16523* (2013.01); *B41J 2/17509* (2013.01)

(58) Field of Classification Search
None
See application file for complete search history.

(56) References Cited

U.S. PATENT DOCUMENTS

| | | | |
|---|---|---|---|
| 6,273,546 | B1 | 8/2001 | Kobayashi et al. |
| 2004/0027409 | A1 | 2/2004 | Miyauchi |
| 2008/0043055 | A1 | 2/2008 | Mizutani et al. |

FOREIGN PATENT DOCUMENTS

| | | | |
|---|---|---|---|
| CN | 101314283 | A | 12/2008 |
| JP | H11-138831 | A | 5/1999 |
| JP | 2002-361900 | A | 12/2002 |
| JP | 2003-103805 | A | 4/2003 |
| JP | 2004-082579 | A | 3/2004 |
| JP | 2006-123194 | A | 5/2006 |
| JP | 2007-196612 | A | 8/2007 |
| JP | 2008-023889 | A | 2/2008 |

OTHER PUBLICATIONS

State Intellectual Property Office of the People's Republic of China, Notification of the Second Office Action for Chinese Patent Application No. 201110078877.9 (counterpart to above-captioned patent application), mailed Nov. 27, 2013.

The State Intellectual Property Office of the People's Republic of China, Notification of First Office Action for Chinese Patent Application No. 201110078877.9 (counterpart to co-pending U.S. Appl. No. 13/073,526), issued May 2, 2013.

*Primary Examiner* — Justin Seo
(74) *Attorney, Agent, or Firm* — Baker Botts L.L.P.

(57) ABSTRACT

There is provided a cap device including: a cap unit which is tiltable in a plane direction of the jetting surface and which comes into close contact with the jetting surface of the liquid jetting head; a flexible discharge tube of which one end is connected to the cap unit, which communicates with an inner space defined by the cap unit and the jetting surface under a condition that the cap unit comes into close contact with the jetting surface, and through which a liquid in the inner space is discharged; and a fixing mechanism which fixes a portion, of the discharge tube, other than the one end to the cap unit.

18 Claims, 9 Drawing Sheets

CAP DEVICE AND LIQUID JETTING APPARATUS PROVIDED WITH THE SAME

CROSS REFERENCE TO RELATED APPLICATION

The present application is a continuation of U.S. patent application Ser. No. 13/073,526, filed on Mar. 28, 2011, which claims priority from Japanese Patent Application No. 2010-104770, filed on Apr. 30, 2010, the disclosures of which are incorporated herein by reference in their entirety.

BACKGROUND OF THE INVENTION

1. Field of the Invention

The present invention relates to a cap device provided in a liquid jetting apparatus and a liquid jetting apparatus provided with the cap device.

2. Description of the Related Art

A liquid jetting apparatus having a liquid jetting head for jetting liquid often includes a cap device having a cap member capable of covering a liquid jetting surface of the liquid jetting head. For example, in an ink-jet type primer (a liquid jetting apparatus) described in Japanese Patent Application Laid-open No. 2007-196612 (FIG. 4), there is provided a cap device including: a recessed-shaped cap member capable of covering a liquid jetting surface of a liquid jetting head and easily tiling; a suction pump sucking and discharging liquid jetted into an inner space of the cap member from the liquid jetting head; and a discharge tube connecting the cap member and the suction pump. In the above cap device, the cap member covers the liquid jetting surface and the suction pump is driven, and thereby the inner space of the cap member is sucked to have a negative pressure. Thereby, air bubbles and thickened liquid are ejected from the liquid jetting head and the liquid received in the inner space of the cap member is discharged through the discharge tube.

However, the discharge tube connected to the cap member is routed or drawn through a narrow space to the suction pump, along with miniaturization of the cap device, for example. Then, the discharge tube connected to the cap member is curved to form an arched shape expanding toward outer side, thereby coming into contact with peripheral members to generate reaction force. The reaction force locally acts on a connection portion of the discharge tube to the cap member. Then, the cap member to which the discharge tube is connected tilts. Then, there is a risk for causing such problems that, for example, the liquid discharged into the inner space of the cap member by the suction pump spills, and that a gap is generated when the cap member comes into close contact with the liquid jetting surface.

SUMMARY OF THE INVENTION

Then, an object of the present invention is to provide a cap device preventing a cap member from tilting and a liquid jetting apparatus provided with the same.

According to a first aspect of the present invention, there is provided a cap device which covers a jetting surface of a liquid jetting head to recover a jetting performance of the liquid jetting head, the cap device including:

a cap unit which is tiltable in a plane direction of the jetting surface and which comes into close contact with the jetting surface of the liquid jetting head;

a flexible discharge tube of which one end is connected to the cap unit, which communicates with an inner space defined by the cap unit and the jetting surface under a condition that the cap unit comes into close contact with the jetting surface, and through which a liquid in the inner space is discharged; and a fixing mechanism which fixes a portion, of the discharge tube, other than the one end to the cap unit.

Moreover, the cap unit may include: a cap member which comes into close contact with the jetting surface, the cap member having a bottom wall portion facing the jetting surface and an annular lip provided to project from the bottom wall portion toward a jetting surface; and a cap holder which holds the bottom wall portion of the cap member and which is tiltable in the plane direction of the jetting surface, and the fixing mechanism may fix a portion, of the discharge tube, other than the one end to the cap holder.

According to the cap device of the present invention, for example, the discharge tube has the one end thereof connected to the cap holder, and the portion different from a connection portion is fixed by the fixing mechanism on the cap holder so that displacement is restricted. In the above case, it becomes difficult that the discharge tube having the one end thereof connected to the cap holder comes into contact with a peripheral member to generate a reaction force. Further, in the case when the discharge tube is fixed to the cap holder by the fixing mechanism, the cap holder and the discharge tube are united, and a repulsive force to be generated when the discharge tube is bent is reduced. Accordingly, it is possible to prevent the cap member held by the cap holder from tilting.

According to a second aspect of the present invention, there is provided a liquid jetting apparatus which jets two kinds of liquids, including:

a jetting head having a jetting surface on which a first nozzle and a second nozzle through which the two types of liquids are jetted, respectively, are formed; and the cap device according to the first aspect of the present invention.

The discharge tube has the one end thereof connected to the cap holder and has the portion different from the connection portion fixed by the fixing mechanism on the cap holder. Thereby, it becomes difficult that the discharge tube having the one end thereof connected to the cap holder comes into contact with the peripheral member to thereby generate a reaction force. Further, the discharge tube is fixed to the cap holder by the fixing mechanism, so that the cap holder and the discharge tube are united and a repulsive force to be generated when the discharge tube is bent is reduced. Accordingly, it is possible to prevent the cap member held by the cap holder from tilting.

BRIEF DESCRIPTION OF THE DRAWINGS

FIG. 7A is when the cap member is positioned at a retraction position, and FIG. 7B is when the cap member is positioned at a capping position;

FIG. 3 is seen from below; and

DETAILED DESCRIPTION OF THE PREFERRED EMBODIMENTS

Next, an embodiment of the present invention will be explained. In this embodiment, the present invention is applied to a cap device provided in a printer as a liquid jetting apparatus which jets ink onto a recording paper from an ink-jet head to thereby record or print a desired letter, image, or the like on the recording paper.

<Schematic Structure of Printer>

Figure 1:
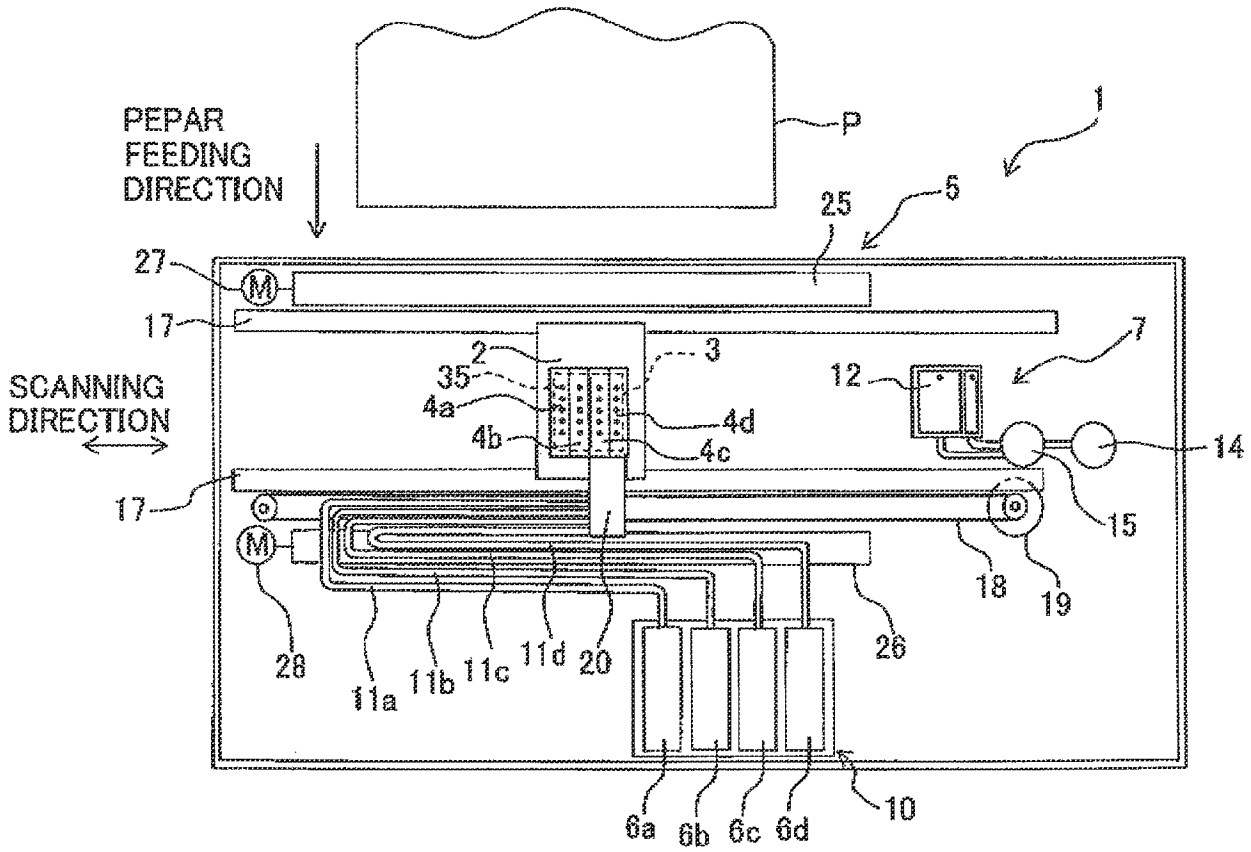
FIG. 1 is a plane view showing a schematic structure of a printer according to an embodiment.

As shown in FIG. 1, a printer 1 is provided with a carriage 2 formed to be capable of reciprocating along one direction (scanning direction), an ink-jet head 3 (liquid jetting head) and sub-tanks 4*a* to 4*d* mounted on the above carriage 2, a transporting mechanism 5 transporting a recording paper P in a paper feeding direction, ink cartridges 6*a* to 6*d* each storing ink therein, a cap device 7 recovering an ink jetting performance of the ink-jet head 3 when the performance of the ink-jet head 3 lowers.

The carriage 2 is formed to be capable of reciprocating along two guide shafts 17 extending in parallel in the scanning direction (a right and left direction in FIG. 1). Further, an endless belt 18 is coupled to the carriage 2. When the endless belt 18 is driven by a carriage drive motor 19, the carriage 2 moves in the scanning direction as the endless belt 18 runs.

The above carriage 2 has the ink-jet head 3 and the four sob-tanks 4*a* to 4*d* mounted thereon. The ink-jet head 3 jets ink onto the recording paper P to be transported in the paper feeding direction (downward in FIG. 1) by the transporting mechanism 5 from nozzles 35 formed on an ink jetting surface 38 (see FIG. 5A), while reciprocating in the scanning direction together with the carriage 2. Thereby, a desired letter, image, or the like is recorded on the recording paper P. Incidentally, the ink jetting surface 38 is directed to a far side with respect to the plane of the paper in FIG. 1, The four sub-tanks 4*a* to 4*d* are arranged in a row along the scanning direction. Further, a tube joint 20 is integrally provided on the four sub-tanks 4*a* to 4*d*. Then, the four sub-tanks 4*a* to 4*d* and the four ink cartridges 6*a* to 6*d* are connected respectively via flexible tubes 11*a* to 11*d* coupled to the tube joint 20.

Four color inks of magenta, cyan, yellow, and black are stored in the four ink cartridges 6*a* to 6*d*, respectively, and these ink cartridges 6*a* to 6*d* are detachably installed in a holder 10. The four color inks stored in the four ink cartridges 6*a* to 6*d* are temporarily stored in the sub-tanks 4*a* to 4*d*, and then are supplied to the ink-jet head 3.

The transporting mechanism 5 has a paper feeding roller 25 disposed at an upstream side of the ink-jet head 3 in the paper feeding direction and a paper discharge roller 26 disposed at a downstream side of the ink-jet head 3 in the paper feeding direction. The paper feeding roller 25 and the paper discharge roller 26 are driven by a paper feeding motor 27 and a paper discharge motor 28 respectively. Then, the above transporting mechanism 5 is configured to supply the recording paper P to the ink-jet head 3 from the upper side in FIG. 1 by the paper feeding roller 25 and to discharge the recording paper P, on which a letter, image, or the like is recorded by the ink-jet head 3, downward in FIG. 1 by the paper discharge roller 26.

<Structure of Ink-Jet Head>

The ink-jet head 3 includes a piezoelectric actuator and a channel unit in which the plurality of nozzles 35, and ink channels are formed. In the channel unit, the inks supplied from the four sub-tanks 4*a* to 4*d* are sent to the nozzles 35 through the ink channels. Then, the ink-jet head 3 applies jetting pressures to the inks, which are supplied into the ink channels of the channel unit from the four sub-tanks 4*a* to 4*d*, to jet the inks from the nozzles 35 by the piezoelectric actuator. The nozzles 35 are opened on a lower surface of the ink-jet head 3. The nozzles 35 form four nozzle rows arranged in the scanning direction. Each of the nozzle rows extends in the paper feeding direction. The lower surface of the ink-jet head 3 forms the ink jetting surface 38 (see FIG. 5A) on which the nozzles 35 are opened respectively, and the four color inks of magenta, cyan, yellow, and black are jetted from the four nozzle rows respectively.

<Structure of Cap Device>

Figure 2:
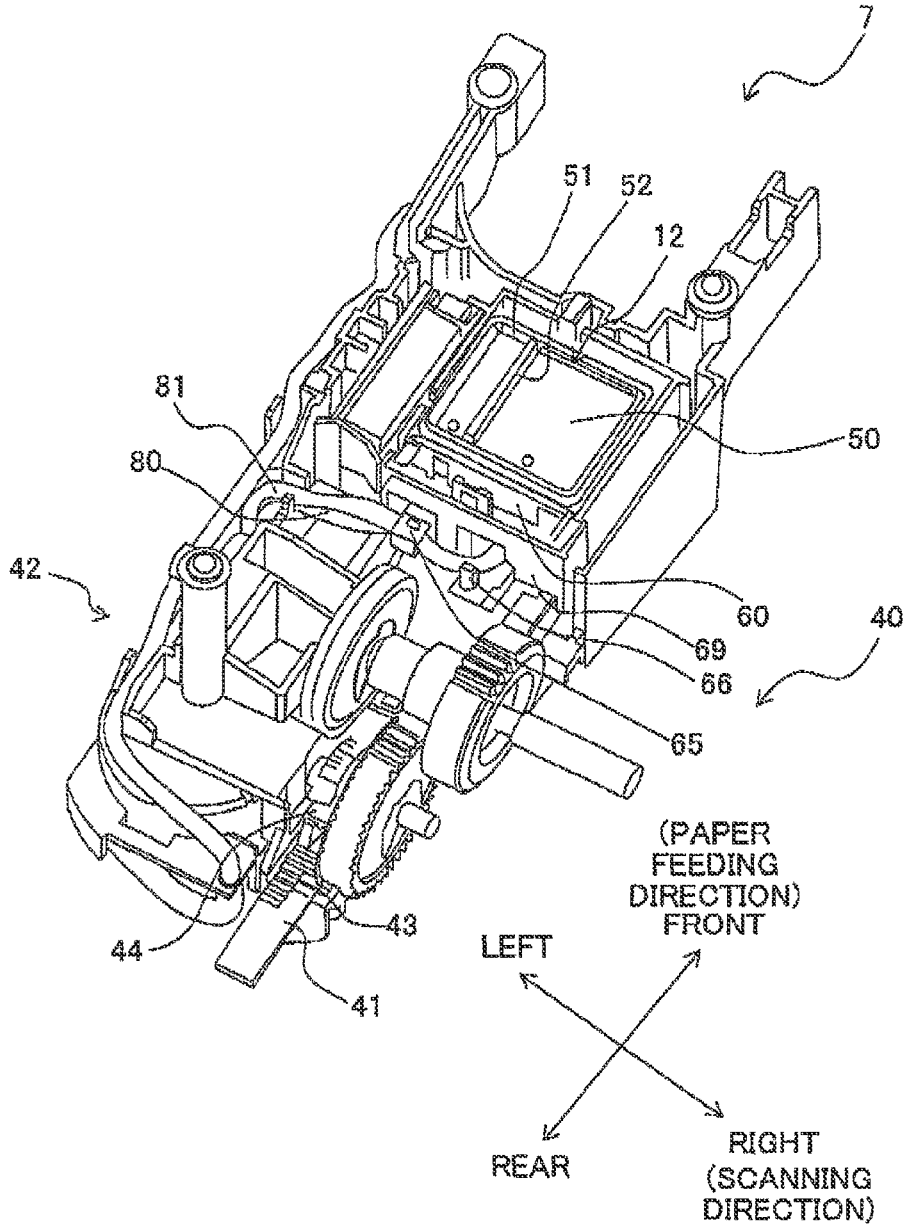
FIG. 2 is a perspective view of a cap device.

Next, the cap device 7 will be explained. In the following explanation, the left and right in FIG. 2 are defined as the left and right in the scanning direction, and the upper side and the lower side in FIG. 2 (paper feeding direction upstream side and down stream side) are defined as the front and the rear in the paper feeding direction. Further, in FIG. 3, the illustration of a drive motor 42 shown in FIG. 2 is omitted. The cap device 7 performs a suction purge in which inks are forcibly discharged from the nozzles 35 of the ink-net head 3 to recover the ink jetting performance of the ink-jet head 3.

Figure 3:
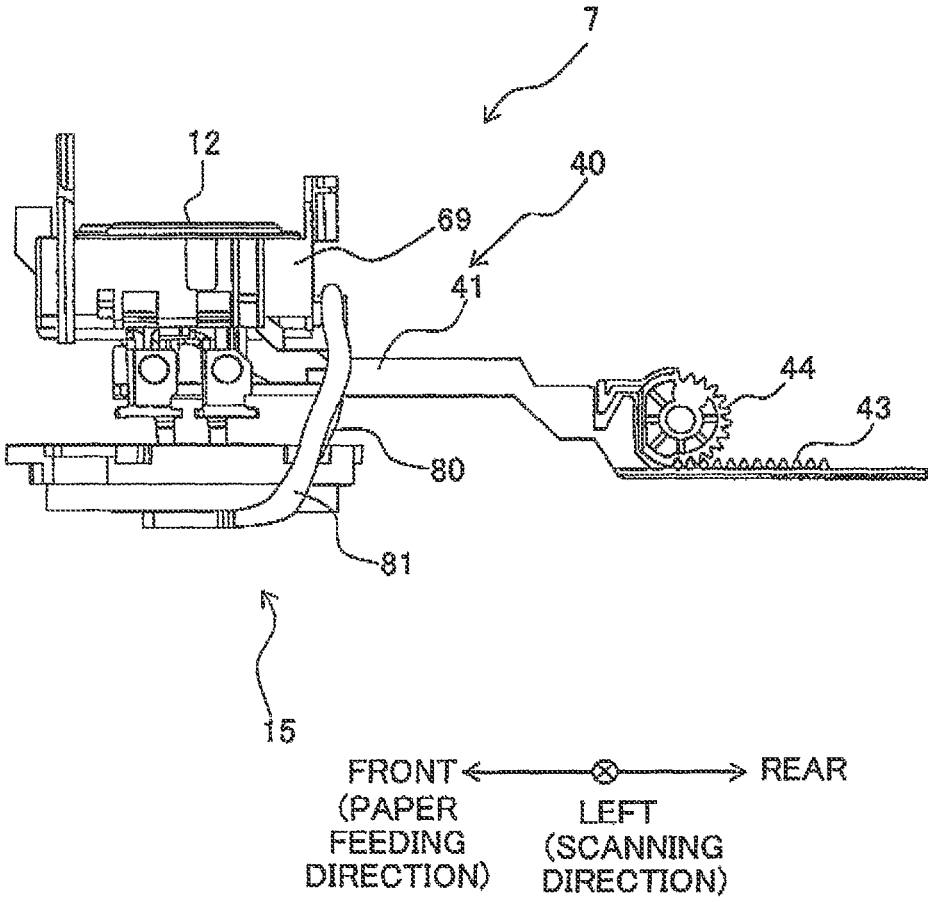
FIG. 3 is a side view of the cap device.

As shown in FIGS. 1 to 3, within a moving range of the carriage 2 in the scanning direction, the cap device 7 is disposed at a position (a maintenance position) more outside than a printing zone facing the recording paper P (on the right in FIG. 1). The cap device 7 is provided with a cap member 12 capable of coming into close contact with the ink jetting surface 38 of the ink-jet head 3, a cap holder 60 holding the cap member 12 from below thereof, a cap lift holder 69 holding the cap holder 60 from below thereof, a suction pump 14, a switching mechanism 15 switching a connection destination of the suction pump 14, two discharge tubes 80, 81 connecting the cap member 12 and the switching mechanism 15, a cap drive mechanism 40 driving the cap holder 60 and the cap member 12 to move up and down together with the cap lift holder 69, and so on. Incidentally, the suction pump 14 and the switching mechanism 15 in this embodiment correspond to a discharge unit in the present invention. Further, the cap member 12 and the cap holder 60 in this embodiment correspond to a cap unit in the present teaching.

<Structure of Cap Member>

Figure 4:
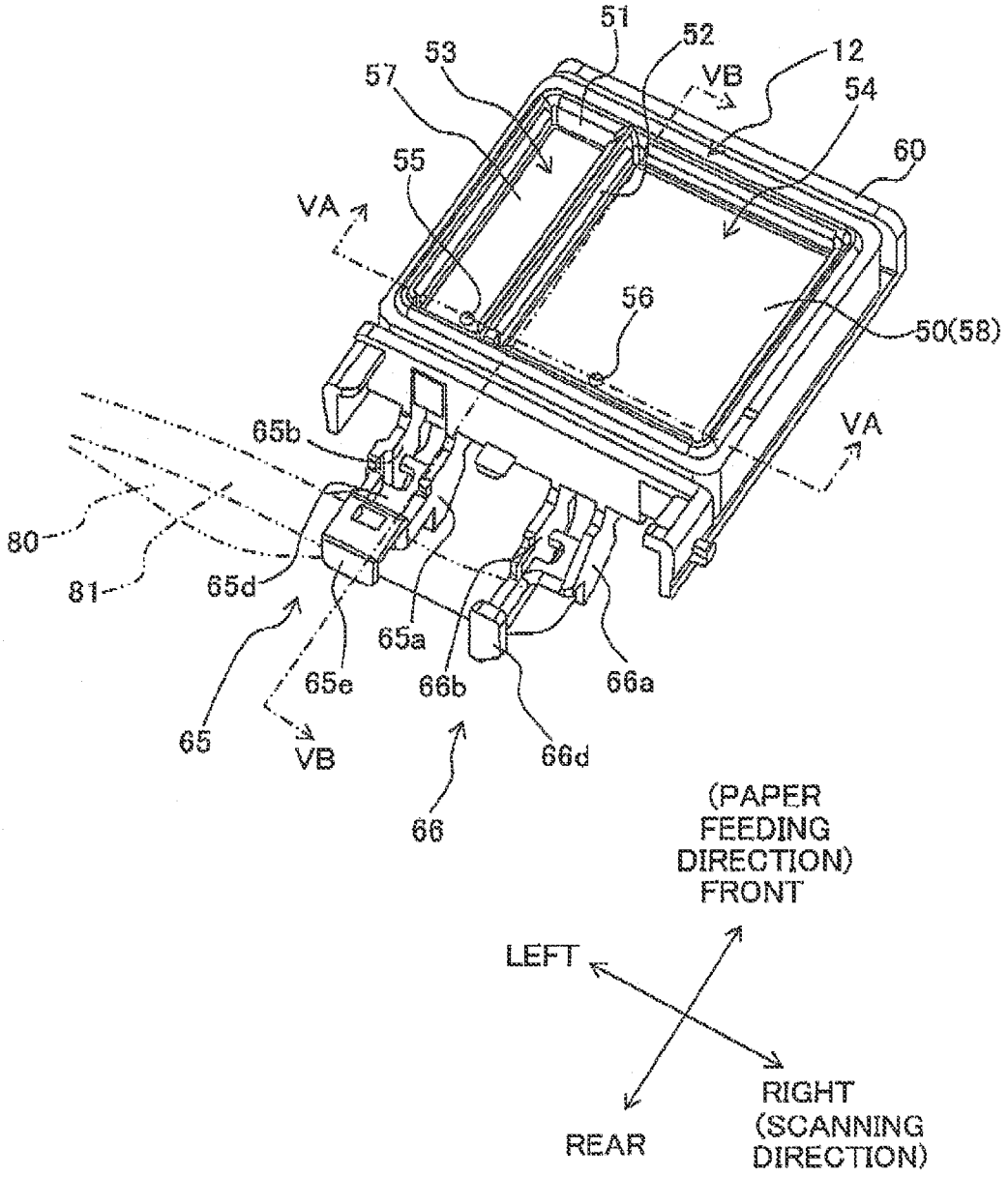
FIG. 4 is a perspective view when a cap holder is seen from above.
Figure 5A:
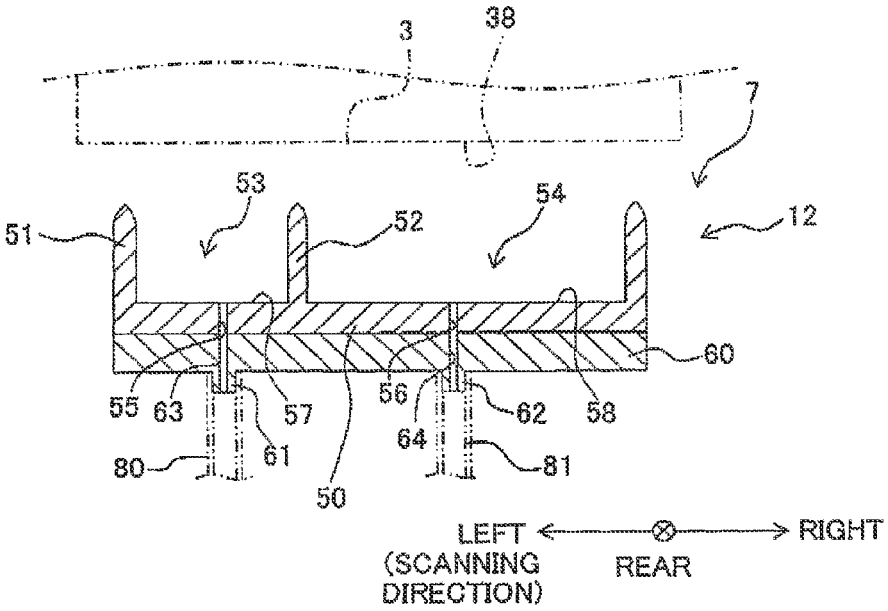
FIG. 5A and FIG. 5B are cross sectional views of FIG. 4.
Figure 5B:
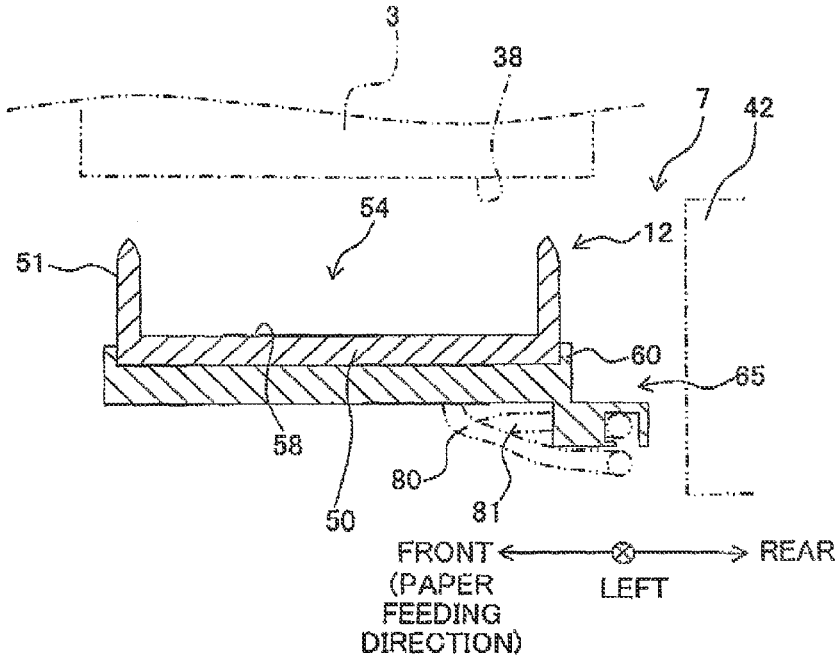

First, the cap member 12 will be explained. As shown in FIGS. 4, 5A and 5B, the cap member 12 has a rectangular bottom wall 50, an annular lip 51 provided upright along an edge of the bottom wall 50, and a partition plate 52 provided upright from the bottom wall 50 and partitioning an inner space of a recessed portion defined by the annular lip 51 and the bottom wall 50 into two sub spaces. The cap member 12 is integrally molded of an elastic member such as rubber.

The partition plate 52 extends along the paper feeding direction to couple between mid-portions of portions, of the lip 51, extending in the scanning direction. Then, the partition plate 52 partitions the recessed portion that is demarcated by the annular lip 51 and the bottom wall 50 and is formed in a rectangular shape of which upper portion is opened into two recessed portions 57, 58. Thereby, the inner space of the cap member 12 is divided into two of an inner space 53 for the black ink and an inner space 54 for the three color inks (cyan, magenta, and yellow).

The recessed portion 57 is positioned to the left of the recessed portion 58. A bottom surface of the rectangular recessed portion 57 feces the nozzles 35 for jetting the black ink, when the ink-jet head 3 moves to the maintenance position. A bottom surface of the rectangular recessed portion 58 faces the nozzles 35 for jetting the three color inks, when the ink-jet head 3 moves to the maintenance position. The single nozzle row corresponds to the nozzles 35 for jetting the black ink, in the meantime, the three nozzle rows correspond to the nozzles 35 for jetting the three color inks. Thus, a length of the recessed portion 58 in the scanning direction is longer than that of the recessed portion 57 in the scanning direction so that the recessed portion 58 can cover the corresponding nozzle rows entirely. Then, a through hole 55 passing through the bottom wall 50 in a thickness direction is formed in a rear end portion of the bottom wall 50 composing the recessed portion 57. Further, a through hole 56 passing through the bottom wall 50 in the thickness direction is formed in a rear end portion of the bottom wall 50 composing the recessed portion 58.

<Structure of Cap Holder>

Figure 6:
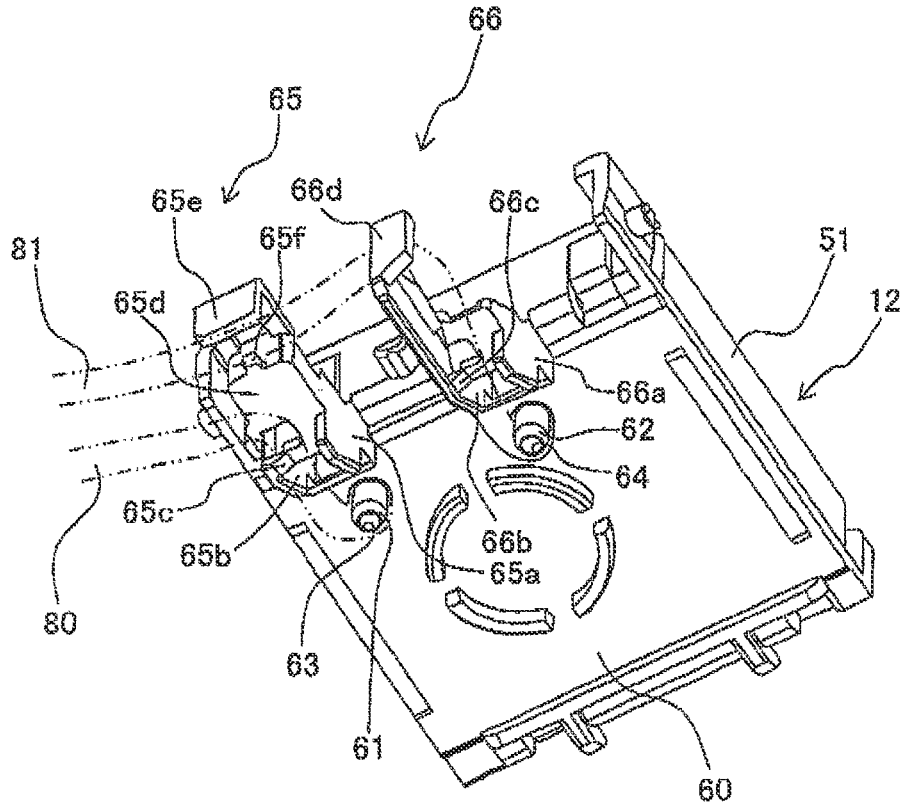
FIG. 6 is a perspective view when the can holder is seen from below.
Figure 6:
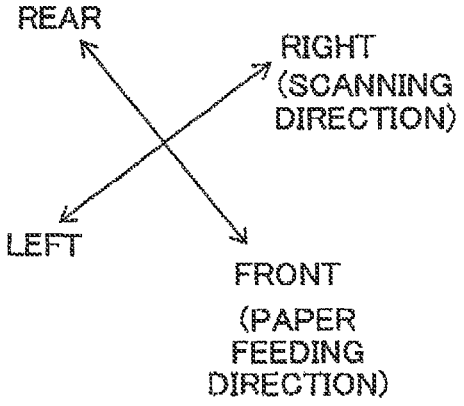

Next, the cap holder 60 will be explained. The cap holder 60 is formed of a member such as synthetic resin that is more rigid than that of the cap member 12. As shown in FIGS. 4 to 6, both end portions of the cap holder 60 in the paper feeding direction are formed to project upward, and a recessed portion is formed at a center portion of the cap holder 60. The cap member 12 is placed on the recessed portion of the cap holder 60 to be held from below thereof. Further, the cap holder 60 is held by the cap lift holder 69 via a spring 68 (see FIG. 7A). The cap lift holder 69 is coupled to a later-described cap slide cam 41 of the cap drive mechanism 40 to be capable of tilting in a horizontal plane direction. In other words, the cap lift holder 69 is coupled to the cap slide cam 41 of the cap drive mechanism so as to be tiltable in any direction of the horizontal plane direction. Here, the horizontal plane direction is a plane direction of a plane including the paper feeding direction and the scanning direction, and is coincident with a plane direction of horizontal surfaces 41*a*, 41*c* of the later-described cap slide cam 41. A projecting portion 61 projecting downward and a connection hole 63 passing through a center axis of the projecting portion 61 are formed at a position, of the cap holder 60, overlapping the through hole 55 in the bottom wall 50 of the cap member 12 in a plane view. A projecting portion 62 projecting downward and a connection hole 64 passing through an axis core of the protecting portion 62 are formed at a position, of the cap holder 60, overlapping the through hole 56 in the bottom wall 50 of the cap member 12.

Further, two fixing members 65, 66 (fixing mechanisms) fixing the two discharge tubes 80, 81 to the cap holder 60 are formed on a rear end portion of a lower surface, of the cap holder 60, facing the cap slide cam 41. The fixing member 65 is disposed adjacently to the projecting portion 61 in the paper feeding direction. Further, the fixing member 65 has two sidewalk 65*a*, 65*b* disposed apart to sandwich the projecting portion 61 in the scanning direction, a first projection 65*c* projecting to the right (a sidewall 65*a* side) from a lower end portion of the sidewall 65*b*, an upper wall 65*d* extending rearward on the two sidewalls 65*a*, 65*b*, a supporting wall 65*e* projecting rearward from an upper end portion of the upper wall 65*d* and bent downward, and a second projection 65*f* projecting rearward from a lower end portion of the upper wall 65*d*.

The fixing member 66 is disposed to be adjacent to the fixing member 65 in the scanning direction and adjacent to the projecting portion 62 in the paper feeding direction. Further, the fixing member 66 has two sidewalls 66*a*, 66*b* which are disposed apart to sandwich the projecting portion 62 in the scanning direction and are different in length in the paper feeding direction, a first projection 66*c* which is positioned at the same position as that of the first projection 65*c* in the paper feeding direction and is projecting to the right (a sidewall 66*a* side) from a lower end portion of the sidewall 66*b*, and a supporting wall 66*d* which is extending to the right from a rear end portion of the sidewall 66*b* and is extending more upward than the sidewall 66*b*. Then, an upper end portion of the supporting wall 65*e* and an upper end portion of the supporting wall 66*d* are the same in height, and the lower end portion of the upper wall 65*d* and an upper end portion of the sidewall 66*b* are the same in height.

The discharge tube 80 has flexibility. One end of the discharge tube 80 is connected to the projecting portion 61 on the can holder 60 communicating with the through hole 55 formed in the recessed portion 57 for the black ink of the cap member 12 (see FIG. 6). The other end of the discharge tube 80 is connected to a later-described Bk port 95*b* of the switching mechanism 15 (see FIG. 8). The discharge tube 81 has flexibility. One end of the discharge tube 81 is corrected to the projecting portion 62 on the cap holder 60 communicating with the through hole 56 formed in the recessed portion 58 for the color inks of the cap member 12 (see FIG. 6). The other end of the discharge tube 81 is connected to a later-described Co port 95*a* of the switching mechanism 15 (see FIG. 8). A structure of the two discharge tubes 80, 81 which are drawn from the cap holder 60 to the switching mechanism 15 by using the two fixing members 65, 66 will be described later.

<Structure of Cap Drive Mechanism>

Next, the cap drive mechanism 40 will be explained. As shown in FIGS. 2 and 3, the can drive mechanism 40 has the cap slide cam 41 (a slide member) formed movably in the paper feeding direction to drive the cap holder 60 to move up and down, the drive motor 42 (a drive mechanism) moving the cap slide cam 41 in the paper feeding direction, and so on.

Figure 7A:
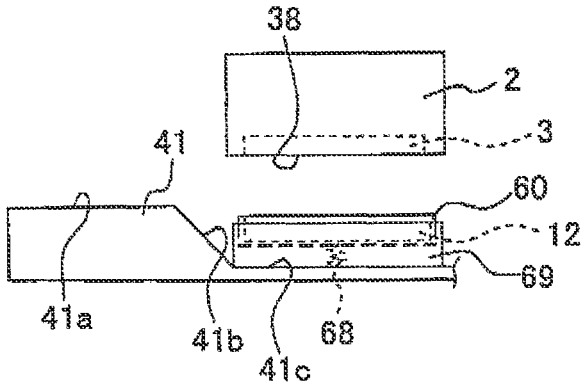
FIG. 7A and FIG. 7B are views explaining a separating/approaching operation of a cap member.

As shown in FIGS. 3 and 7A, the cap slide cam 41 is disposed under the cap lift holder 69 holding the cap holder 60, and has the horizontal surface 41*a* extending in the paper feeding direction, an inclined surface 41*b* continuing to the horizontal surface 41*a* and extending rearward in the paper feeding direction to be inclined downward, and the horizontal surface 41*c* continuing to the inclined surface 41*b* and extending in the paper feeding direction. Then, a lower surface of the cap lift holder 69 slidably comes into contact with one of the horizontal surface 41*a*, the inclined surface 41*b*, and the horizontal surface 41*c* of the cap slide cam 41, and a height position of the cap lift holder 69 is determined depending on the height of the surface of the cap lift holder 69 in contact with the cap slide cam 41.

Further, a rack gear 43 extending rearward in the paper feeding direction and having a length longer than a total length of the horizontal surface 41*a*, the inclined surface 41*b*, and the horizontal surface 41*c* in the paper feeding direction is provided at a rear end portion of the cap slide cam 41 forming the horizontal surface 41*c*, and a pinion gear 44 coupled to the drive motor 42 is engaged with the rack gear 43. The drive motor 42 is adjacently disposed at the rear of the cap lift holder 69 in the paper feeding direction (see FIG. 2). Then, the pinion gear 44 is rotated by the drive motor 42, and along with the rotation of the pinion gear 44, the cap slide cam 41 moves in the paper feeding direction below the cap member 12 together with the rack gear 43 engaging with the pinion gear 44. Then, the cap lift holder 69 slides over the horizontal surface 41*a*, the inclined surface 41*b*, and the horizontal surface 41*c* of the cap slide cam 41 by the above movement of the cap slide cam 41. With the slide, the cap lift holder 69 moves up and down corresponding to the height position of the horizontal surface 41*a*, the inclined surface 41*b*, and the horizontal surface 41*c*. Incidentally, in the above case, the position of the cap lift holder 69 in a horizontal direction does not change.

<Separating/Approaching Operation of Cap Member with Respect to Ink Jetting Surface>

Next, a separating/approaching operation of the cap member 12 with respect to the ink jetting surface 38 of the ink-jet head 3 will be explained. As shown in FIG. 7A, before the suction purge is started, the cap slide cam 41 is positioned at a front end portion in the paper feeding direction. At this time, the lower surface of the cap lift holder 69 is in a state of being in contact with the horizontal surface 41*c* of the cap slide cam 41 to be moved down, and the cap member 12 is positioned at the retraction position separated from the ink jetting surface 38 of the ink-jet head 3.

Figure 7B:
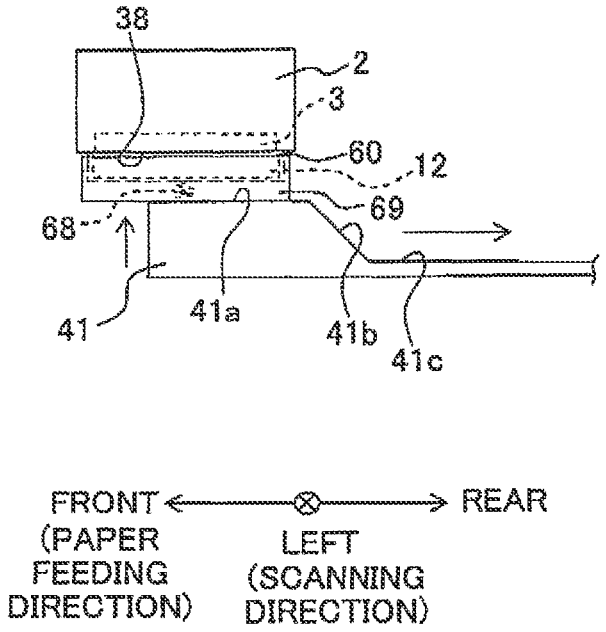

Then, when the cap slide cam 41 moves rearward in the paper feeding direction by the drive motor 42, the lower surface of the cap lift holder 69 slides on the horizontal surface 41*c* of the cap slide cam 41, and then moves up while sliding on the inclined surface 41*b*. Then, as the cap lift holder 69 moves up, the cap member 12 also moves up from the retraction position. Then, as shown in FIG. 7B, when the cap slide cam 41 moves further rearward and the cap member 12 moves to the capping position, the cap slide cam 41 stops. Then, the cap lift holder 69 moves to the position where the lower surface of the cap lift holder 69 comes into contact with the horizontal surface 41*a* of the cap slide cam 41, and the cap member 12 comes into close contact with the ink jetting surface 38 of the ink-jet head 3.

Incidentally, the position of the cap slide cam 41 in the paper feeding direction can be detected by the number of rotations of the drive motor 42. Thereby, the position of the cap slide cam 41 in the paper feeding direction is controlled, thereby enabling the cap member 12 to be driven in a direction approaching to/separating from the ink jetting surface 38 between the retraction position and the capping position.

<Structure of Switching Mechanism>

Figure 8:
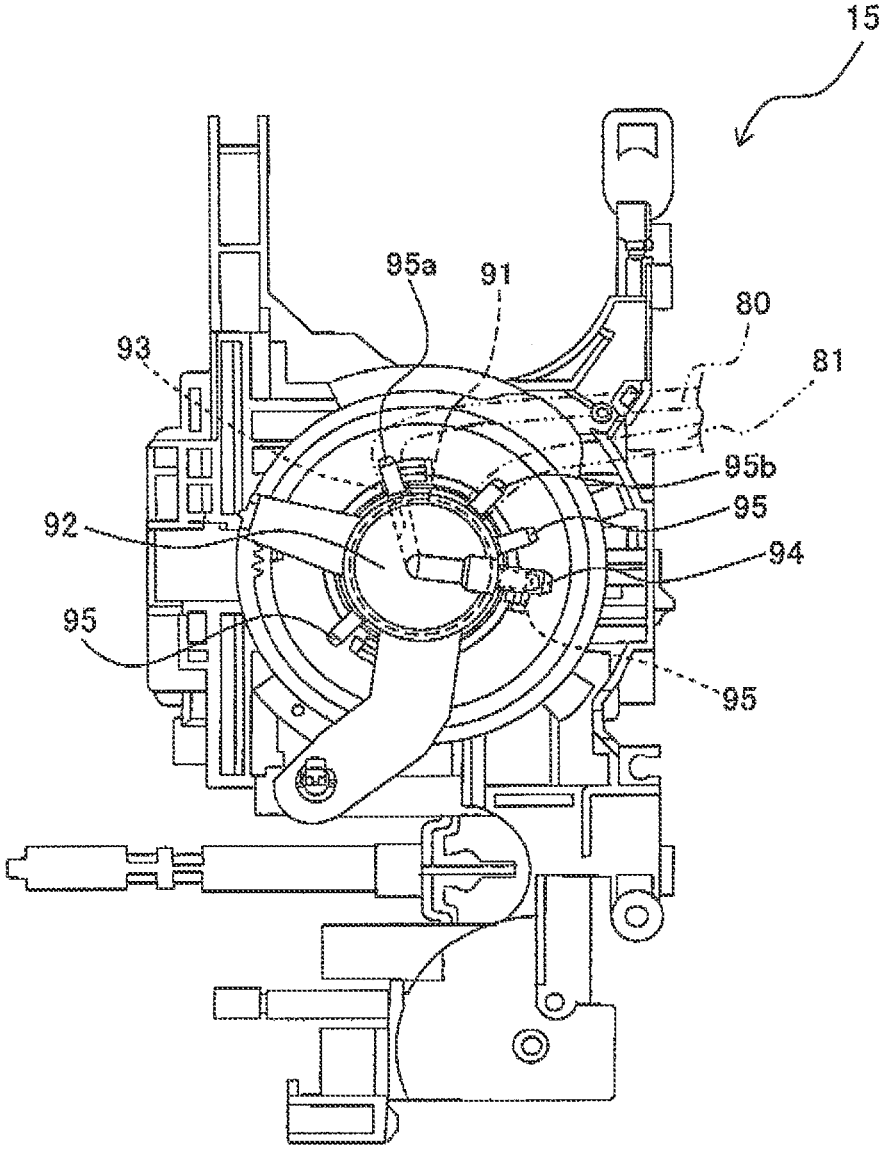
FIG. 8 is a bottom view when

Next, the switching mechanism 15 will be explained. In FIG. 8, the two discharge tubes 80, 81 shown in FIG. 3 are shown by two-dot chain lines. As shown in FIGS. 3 and 8, the switching mechanism 15 selectively switches the connection destination of the suction pump 14 to the inner space 53 of the recessed portion 57 for the blank ink or the inner space 54 of the recessed portion 58 for the color inks. The switching mechanism 15 is disposed below the cap lift holder 69 with the cap slide cam 41 intervening therebetween.

The switching mechanism 15 has a suction port 94 formed at a center of a bottom wall of a cover 92 in a bottomed cylindrical shape, a plurality of ports 95 formed on a peripheral wall of the cover 92, and a switching member 91 housed inside the cover 92 and having a branch groove 93 that extends in a radial direction from the center formed therein. The suction port 94 is connected to the suction pump 14 via a not-illustrated tube. The ports 95 include the Bk port 95*b* connected to the discharge tube 80 to communicate with the inner space 53 for the black ink of the cap member 12, and the Co port 95*a* connected to the discharge tube 81 to communicate with the inner space 54 for the color inks of the cap member 12.

Then, depending on a rotation angle of the switching member 91, the switching mechanism 15 is formed to enable the suction pump 14 to communicate with the inner space 53 for the black ink of the cap member 12 through the Bk port 95*b* and the discharge tube 80, and to enable the suction pump 14 to communicate with the inner space 54 for the color inks of the cap member 12 through the Co port 95*a* and the discharge tube 81. The rotation angle of the switching member 91 can be determined or obtained by the number of rotations of a not-illustrated motor for driving the switching member 91. Therefore, when the number of rotations of the motor is controlled, the switching member 91 can be rotated only at an arbitrary rotation angle. Here, the switching mechanism 15 functions as an opening/closing valve coupled to the other ends of the discharge tubes 80, 81. That is, the switching mechanism 15 opens the other end of one of the discharge tubes 80 and 81 so that the suction pump 14 and one of the inner spaces 53 and 54 communicate, and closes the other end of one of the discharge tube 80 and 81 so that the suction pump 14 and one of the inner space 53 and 54 do not communicate.

<Routing Structure of Discharge Tubes>

Next, the structure of the two discharge tubes 80, 81 being drawn from the cap holder 60 to the switching mechanism 15 will be explained. As shown in FIG. 6, the one end of the discharge tube 80 is connected to the connection hole 63 in the cap holder 60 communicating with the through hole 55 formed in the recessed portion 57 for the black ink. Then, the discharge tube 80 having the one end thereof connected to the connection hole 63 and extending in a vertical direction is bent rearward and is routed or drawn between the two sidewalls 65*a* and 65*b* of the fixing member 65. Further, the discharge tube 80 is fixed by the first projection 65*c* from therebelow while being sandwiched between the two sidewalls 65*a* and 65*b*. That is, at the portion of the discharge tube 80 sandwiched between the two sidewalls 65*a* and 65*b*, displacement in the scanning direction is restricted and downward displacement is restricted. Thereby, the discharge tube 80 is fixed by the fixing member 65 in the vicinity of a connection portion to the cap holder 60. Thus, it is prevented that the discharge tube 80 bangs down due to its own weight to come into contact with the cap slide cam 41.

Then, as shown in FIGS. 3, 4, and 8, the discharge tube 80 routed between the two sidewalls 65*a* and 65*b* of the fixing member 65 is bent to the left at a rear end portion of the sidewall 65*b* as a supporting point and is routed downward. Then, the other end of the discharge tube 80 is connected to the Bk port 95*b* of the switching mechanism 15. In this manner, the discharge tube 80 is routed to the left between the cap holder 60 and the cap drive mechanism 40 and is connected to the Bk port 95*b* of the switching mechanism 15 positioned below while avoiding the cap slide cam 41.

Further, as shown in FIG. 6, the one end of the discharge tube 81 is connected to the connection hole 64 in the cap holder 60 communicating with the through hole 56 formed in the recessed portion 58 for the color inks. Then, the discharge tube 81 having the one end thereof connected to the connection hole 64 and extending in the vertical direction is bent rearward and is routed between the two sidewalls 66*a* and 66*b* of the fixing member 66. Further, the discharge tube 81 is fixed by the first projection 66*c* from therebelow while being sandwiched between the two sidewalls 66*a* and 66*b*. That is, at the portion of the discharge tube 81 sandwiched between the two sidewalls 66*a* and 66*b*, displacement in terms of the scanning direction is restricted and downward displacement is restricted. Thereby, similarly to the discharge tube 80, the discharge tube 81 is fixed by the fixing member 66 in the vicinity of a connection portion to the cap holder 60, and thus it is possible to prevent that the discharge tube 81 hangs down due to its owe weight to come into contact with the cap slide cam 41.

Then, the discharge tube 81 routed between the two sidewalls 66*a* and 66*b* of the fixing member 66 is fixed by the supporting wall 66*d* (a first fixing portion) at the rear end portion of the sidewall 66*b*. Thereby, the displacement of the discharge tube 81 in the rearward direction can be restricted and is bent upward to go over the upper end portion of the sidewall 66*b* and is bent to the left over the upper end portion of the sidewall 66*b*. Thereafter, the discharge tube 81 bent to the left is routed between the upper wall 65*d* and the supporting wall 65*e* of the fixing member 65 on the discharge tube 80 and is fixed by the second projection 65*f* (a second fixing portion) from therebelow while being sandwiched between the upper wall 65*d* and the supporting wall 65*e*. Also in the above case, it is prevented that the discharge tube 81 hangs down due to its own weight to come into contact with the cap slide cam 41.

Then, as shown in FIGS. 3, 4 and 8, the discharge tube 81 is routed downward and has the other end thereof connected to the Co port 95*a* of the switching mechanism 15. In this manner, the discharge tube 81 is routed to the left between the cap holder 60 and the cap drive mechanism 40 on the discharge tube 80, and is connected to the Co port 95*a* of the switching mechanism 15 positioned therebelow while avoiding the cap slide cam 41. Incidentally, the two discharge tubes 80, 81 are drawn to the left to be connected to the switching mechanism 15 in order to lengthen the discharge tube 81 than the discharge tube 80. Then, the discharge tube 81 is fixed at points (two points) more than the discharge tube 80 because the discharge tube 81 is longer than the discharge tube 80, resulting that the displacements are firmly restricted. Further, as compared with the discharge tube 80, the discharge tube 81 is also fixed at the portion away from the connection portion connected to the cap holder 60. Thus, the portion in which the cap holder 60 and the discharge tube 81 are united or integrated is lengthened and a repulsive force to be generated when the discharge tube 81 is bent is reduced.

<Suction Purge>

Next, the suction purge will be explained. First, the carriage 2 is moved to the maintenance positron to face the ink jetting surface 38 of the ink-jet head 3 to the cap member 12. In the above state, the pinion gear 44 is driven by the drive motor 42 to move the cap slide cam 41 to the capping position from the retraction position. Then, the cap member 12 comes into close contact with the ink jetting surface 38 of the ink-jet head 3 to cover the nozzles 35.

Then, the switching member 91 is rotated to make the inner space 53 for the black ink between the cap member 12 and the ink jetting surface 38 communicate with the suction pump 14 via the discharge tube 80. When a suction operation of the suction pump 14 is performed in the above state, an air in the above inner space 53 is sucked and the pressure reduces, and the inks are sucked and discharged into the inner space 53 from the nozzles 35 for the black ink. This makes it possible to discharge thickened inks in the nozzles 35 for the blank ink and air bubbles mixed in the ink channel in the ink-jet head 3 from the nozzles 35 together with the inks to recover the ink jetting performance of the ink-jet head 3.

Thereafter, driving of the suction pump 14 is stopped to stop sucking the inks from the nozzles 35. In a state of the ink being received in the inner space 53, the cap member 12 is moved to the retraction position to be separated from the ink jetting surface 38, thereby opening the sealed inner space 53. In the above state, the suction pump 14 is driven again to discharge the ink sucked from the nozzles 35 for the black ink and received in the inner space 53 through the discharge tube 80 (what is called an idle suction operation).

Further, the suction purge for the color inks is performed, first, in the state where the cap member 12 comes into close contact with the ink jetting surface 38 of the ink-set head 3 to cover the nozzles 35, the switching member 91 is rotated to make the inner space 54 for the color inks between the cap member 12 and the ink jetting surface 38 communicate with the suction pump 14 via the discharge tube 81. When the suction operation of the suction pump 14 is performed in the above state, the inks are sucked and discharged into the inner space 54 from the nozzles 35 for the color ink. This makes it possible to discharge thickened inks in the nozzles 35 for the color ink and air bubbles mixed in the ink channels in the ink-jet head 3 from the nozzles 35 together with the inks to recover the ink jetting performance of the ink-jet head 3. Thereafter, similarly to the above-described case of the black ink, the idle suction operation is performed, and thereby the suction pump 14 is driven again to discharge the ink sucked from the nozzles 35 for the color ink and received in the inner space 54 through the discharge tube 81.

According to the cap device 7 in this embodiment, the two discharge tubes 80, 81 have the one ends thereof connected to the cap holder 60 and are fixed by the two fixing members 65, 66 on the cap holder 60 at the positions different from the connection portions so that the displacements are restricted. Thereby, it becomes difficult that the two discharge tubes 80, 81 having the one ends thereof connected to the cap holder 60 come into contact with the peripheral member such as the cap drive mechanism 40 to thereby generate reaction forces, when the discharge tubes 80, 81 are routed to the switching mechanism 15. Further, when the cap member 12 is driven to move up and down by the cap drive mechanism 40, for example, the two discharge tubes 80, 81 tend to bend with the movement to be displaced. However, the two discharge tubes 80, 81 are fixed by the two fixing members 65, 66 on the cap holder 60, so that the cap holder 60 and the two discharge tubes 80, 81 are united and repulsive forces to be generated when the two discharge tubes 80, 81 are berg are reduced. In this manner, reducing the reaction forces and repulsive forces of the two discharge tubes 80, 81 makes it possible to prevent the cap member 12 held by the cap holder 60 from tilting by an effect of the reaction forces and repulsive forces. Thereby, it is possible to prevent the inks received in the two inner spaces 53, 54 of the cap member 12 by the suction purge hour spilling and to prevent a gap from being generated when the cap member 12 is moved to the capping position to come into close contact with the ink jetting surface 38.

Further, the discharge tube 81 for the color inks is bent upward to be fixed by the first projection 66*c* and the supporting wall 66*d* formed on the fixing member 66, so that the displacement of the discharge tube 81 in the vertical direction is restricted. Further, the discharge tube 81 is bent to the left to be fixed by the upper wall 65*d* and the supporting wall 65*e* formed on the fixing member 65, so that the displacement of the discharge tube 81 in the horizontal direction is restricted. In this manner, the discharge tube 81 is fixed at the two points, so that the discharge tube 81 can be firmly fixed. Further, it is possible to route the two discharge tubes 80, 81 between the cap member 12 and the drive motor 42 of the cap drive mechanism 40 while preventing the two discharge tubes 80, 81 from coming into contact with the drive motor 42 of the cap drive mechanism 40 adjacent to the cap holder 60, and to route the two discharge tubes 80, 81 downward to avoid the cap slide cam 41.

Further, when the suction purge is performed at the time of inspection before the printer 1 is shipped, a large amount of inks are discharged into the inner space 54 of the cap member 12 as compared with the inner space 53 because the number of the nozzles 35 for the color inks is greater than that of the nozzles 35 for the black ink. Here, at the time of shipment of the printer 1, there is a risk that the color inks jetted at the inspection are not discharged to remain in the inner space 54, and that the color inks reach the switching mechanism 15 via the discharge tube 81 to then flow backward into the inner space 54. Then, there is a risk that, for example, inks in which the color inks are mixed with a different color ink in the switching mechanism 15, or the color inks are mixed with grease coated on the switching member 91 in the switching mechanism 15 for reducing rotation friction, flow backward to adhere to the ink jetting surface 38. Thus, the discharge tube 81 connected to the inner space 54 into which a large amount of color inks are jetted is lengthened to increase the volume in the discharge tube 81, and thereby it is possible to prevent the color inks jetted into the inner space 54 from reaching the switching mechanism 15 via the discharge tube 81. Further, the discharge tube 81 is longer than the discharge tube 80 and easily hangs down due to its own weight. However, the discharge tube 81 is routed on the discharge tube 80. Thus, even it the discharge tube 81 hangs down, it is possible to hold the discharge tube 81 by the discharge tube 80 from below.

Further, on the cap holder 60, the two projecting portions 61, 62 to which the one ends of the two discharge tubes 80, 81 are connected, and the two fixing members 65, 66 fixing the two discharge tubes 80, 81 are disposed in a row in the paper feeding direction. The two discharge tubes 80, 81 are not routed in the vertical direction but are routed along the paper feeding direction to be fixed by the two fixing members 65, 66, so that it is possible to reduce the printer 1 in size in terms of the vertical direction.

Figure 9:
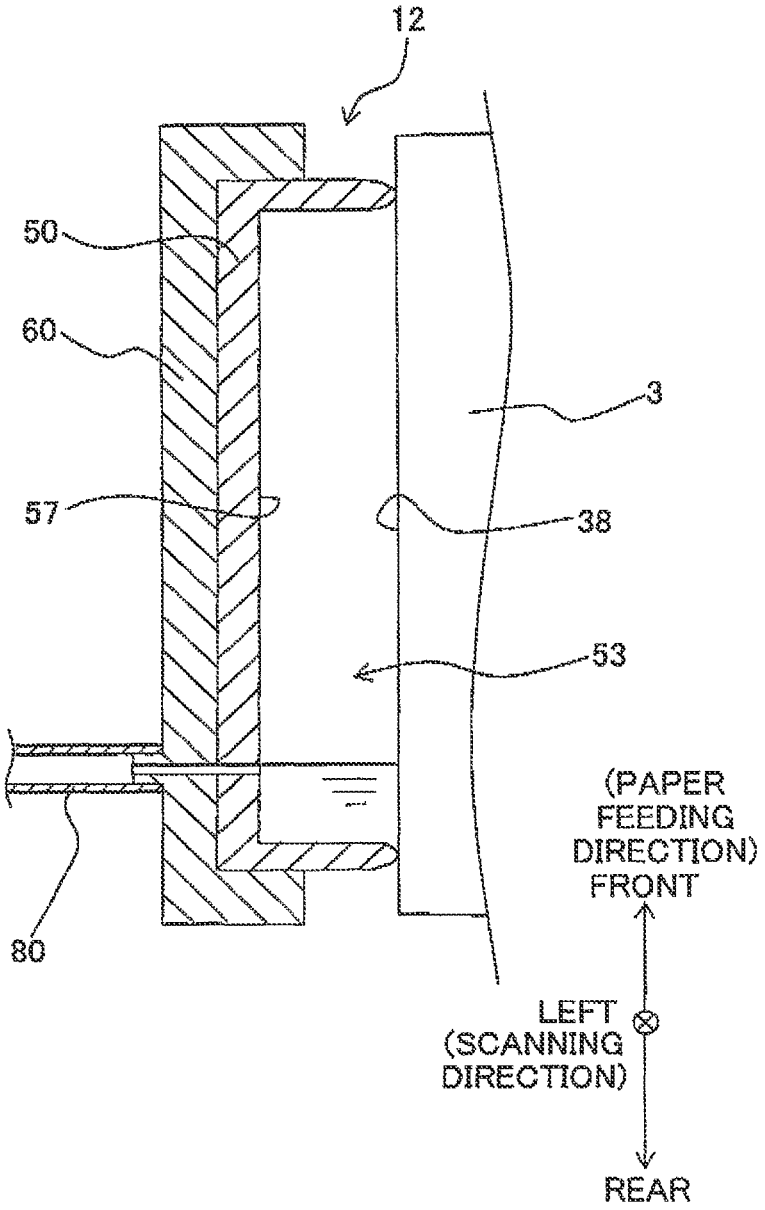
FIG. 9 is a vertical sectional view of a vicinity of the cap member of the printer placed vertically.

Further, at the time of shipment, in order to obtain stability against sway or vibration by conveyance, the pricier 1 is placed vertically in a manner to have the rear (lower side in FIG. 2) positioned at the bottom so that the heavy member such as the drive motor 42 of the cap drive mechanism 40 comes to the lower side. At this time, as shown in FIG. 9, the cap member 12 is disposed vertically so that the bottom wall 50 becomes parallel to the vertical direction. At this time, since the discharge tubes 80 (81) are connected to the rear of the cap holder 60, most of the inks that are jetted to be received in the two inner spaces 53 (54) of the cap member 12 at the time of inspection are to flow into the discharge tubes 80 (81). Thus, the inks received in the inner spaces 53 (54) of the cap member 12 disposed vertically do not come into contact with the regions, of the ink jetting surface 38, having the nozzles 35 formed thereon. This can prevent nozzle clogging ascribable to the fact that the inks received in the inner spaces 53 (54) are dried to be condensed, and the condensed inks adhere to the nozzles 35. At this time, the two discharge tubes 80, 81 are connected to the rear (a drive motor 42 side) of the cap holder 60. Thus, in the case when the two discharge tubes 80, 81 are routed between the cap member 12 and the drive motor 42, there is a risk that curvatures decrease and repulsive forces increase. However, it is possible to reduce the repulsive forces by the two fixing members 65, 66, and to prevent that the discharge tubes 80, 81 come into contact with the drive motor 42 to thereby generate reaction forces.

Next, modified embodiments in which the above-described embodiment is variously modified will be explained. However, components having the structures similar to those of the above-described embodiment will be denoted by the same reference numerals and symbols, and explanation thereof will be omitted when appropriate. Incidentally, these modified embodiments may also be implemented in appropriate combination within a range of the present teaching. Further, the above-described embodiment and the later-described modified embodiments are merely examples of the present teaching, and the present teaching is not interpreted to be limited to them.

The lip 51, of the cap member 12, abutting on the Ink jetting surface 38 is preferably formed of an elastic member such as rubber, but the bottom wall 50 is not necessarily an elastic member in particular, and may also be a plate made of synthetic resin or metal different from the member forming the lip 51. In the above case, as long as the connection portions and the fixed portions of the two discharge tubes 80, 81 are provided on the same member, it may also be designed that the two discharge times 80, 81 are directly connected to the bottom wall 50 and the two fixing members 65, 66 fixing the two discharge tubes 80, 81 are provided on the bottom wall 50, without the cap holder 60 being provided. In the above case, the cap member 12 corresponds to the cap unit of the present teaching.

Further, in this embodiment the two discharge tubes 80, 81 are fixed by the two fixing members 65, 66 from outer peripheral sides of the bent discharge tubes 80, 81, but it may also be designed that an outer peripheral surface of the cap holder 60 and the two discharge tubes 80, 81 are fixed by an adhesive or friction absorption to fix the bent discharge tubes 80, 81 from inner peripheral sides thereof.

Further, it may also be designed that the drive motor 42 of the cap drive mechanism 40 adjacent to the cap holder 60 is used not only as the drive motor for moving the cap member 12 up and down but also as a drive motor for the suction pump 14 and drive motors for other members by switching a plurality of gears coupled to the drive motor, for example.

Further, a cover covering the cap slide cam 41 and the like may also be provided. For example, in the case when the cover is formed to be attached to the printer 1 from above of the cap slide cam 41, the cover comes into contact with the discharge tubes 80, 81 when the cover is attached. Thereby, reaction forces are generated in the discharge tubes 80, 81, and the cap member 12 sometimes tilts. If the tilt of the cap member 12 is such that it cannot be visually recognized, a manufacturer does not notice the tilt of the cap member 12, and there is a risk that the printer 1 is completed as a product in a state of the cap member 12 being on the tilt. In the above case, the cap member 12 cannot come into close contact with the ink jetting surface 38 in the posture of covering the ink jetting surface 38 entirely, and in the worst case, a gap is generated between the cap member 12 and the ink jetting surface 38. However, the discharge tubes 80, 81 are directly connected to the cap holder 60, so that the reaction forces do not act on the discharge tubes 80, 81, resulting that it is possible to prevent the cap member 12 from tilting.

In the above-explained embodiments, the present invention is applied to the cap device provided in the serial-type printer, but an application object of the present invention may also be a cap device provided in a line-type printer. Further, it is possible to apply the present invention not only to the cap device provided in the ink-get type printer but also to cap devices provided in various liquid jetting apparatuses jetting various types of liquids onto objects depending on their use.

What is claimed is:

1. A cap device configured to cover a jetting surface of a liquid jetting head to recover a jetting performance of the liquid jetting head, the cap device comprising:

a cap unit which is tiltable in a plane substantially parallel to the jetting surface, and which is configured to come into close contact with the jetting surface of the liquid jetting head;

a flexible discharge tube of which one end is connected to the cap unit, which is configured to communicate with an inner space defined by the cap unit and the jetting surface under a condition that the cap unit comes into close contact with the jetting surface, and through which a liquid in the inner space is to be discharged; and a fixing mechanism configured to fix a first portion of the discharge tube, other than the one end, and a second portion of the discharge tube, which is farther from the one end than the first portion, wherein the fixing mechanism comprises two first wall portions sandwiching the first portion of the discharge tube in a horizontal direction, two second wall portions sandwiching the second portion of the discharge tube in the horizontal direction, and a projection portion projecting from the one of the second wall portions and being configured to fix the discharge tube.

2. The cap device according to claim 1, wherein the first portion is disposed at a different position from the second portion in a vertical direction substantially perpendicular to the horizontal direction, and the projection portion is disposed farther from the first portion than the second portion in the vertical direction.

3. The cap device according to claim 1, wherein the cap unit includes:

a cap member, which is configured to come into close contact with the jetting surface, an which includes a bottom wall portion facing the jetting surface and an annular lip provided to project from the bottom wall portion toward a jetting surface; and a cap holder, which is configured to hold the bottom wall portion, and which is tiltable in the plane substantially parallel to the jetting surface, and wherein the fixing mechanism is configured to fix a portion of the discharge tube, other than the one end, to the cap holder.

4. The cap device according to claim 3, wherein the bottom wall portion is formed in a flat plate shape, wherein the cap holder includes a plane supporting surface configured to contact with the bottom wall portion in a flat plate shape, and wherein the fixing mechanism includes:

a first fixing portion which is configured to bend the discharge tube, of which one end is connected to the cap holder, in a first direction perpendicular to the supporting surface to fix the discharge tube; and a second fixing portion which is configured to bend the discharge tube, which is bent in the first direction, in a second direction parallel to the supporting surface to fix the discharge tube.

5. The cap device according to claim 3, further comprising: a slide member which is slidable in a horizontal direction and which is disposed under the cap member and the cap holder; and a drive mechanism which is disposed adjacently to the cap member in the horizontal direction and which is configured to drive the slide member to slide, wherein the slide member is formed to move the cap member in a direction approaching to or separating from the jetting surface between a capping position at which the lip comes into close contact with the jetting surface and a retraction position at which the lip is separated from the jetting surface, when sliding in the horizontal direction, and the discharge tube is drawn to pass between the cap member and the drive mechanism.

6. The cap device according to claim 5, wherein the cap holder is coupled to the slide member to be tiltable in the plane substantially parallel to the jetting surface.

7. The cap device according to claim 5, wherein a first surface substantially parallel to the jetting surface, a second surface disposed more away from the jetting surface than the first surface and parallel to the first surface, and an inclined surface connecting the first surface and the second surface are formed on the slide member, the cap unit further includes a cap lift holder which is disposed between the slide member and the cap holder and which is configured to hold the cap holder from a lower side thereof, the cap lift holder is configured to slidably come into contact with the first surface, the second surface, and the inclined surface of the slide member, and the cap member is positioned at the capping position under a condition that the cap lift holder abuts on the first surface, and the cap member is positioned at the retraction position under a condition that the cap lift holder abuts on the second surface.

8. The cap device according to claim 3, wherein the one end of the discharge tube is connected to a bottom surface, of the cap holder, on a side opposite to the cap member, and the fixing mechanism and a connection portion of the cap holder and the one end of the discharge tube are disposed in a row along the bottom surface.

9. The cap device according to claim 5, wherein the cap unit further includes a cap lift holder which is disposed between the slide member and the cap holder and which is configured to hold the cap holder from a lower side thereof, an opening portion is formed in the cap lift holder, and the fixing mechanism is disposed to project from the opening portion.

10. The cap device according to claim 1, further comprising: a valve to which the other end of the discharge tube is connected and which is disposed on a side, of the cap unit, opposite to the jetting surface.

11. The cap device according to claim 1, further comprising: a pump which is connected to the valve to suck the liquid in the inner space via the discharge tube under a condition that the valve is opened.

12. The cap device according to claim 1, wherein the cap unit includes a cap member which includes a bottom wall portion facing the jetting surface and an annular lip provided to project from the bottom wall portion toward the jetting surface side, which is configured to come into close contact with the jetting surface, and which is tiltable in the plane direction of the jetting surface, and the fixing mechanism is configured to fix a portion, of the discharge tube, other than the one end to the bottom wall portion of the cap member.

13. The cap device according to claim 1, further comprising a discharge unit including a pump configured to discharge the liquid in the cap unit via the discharging tube, wherein the other end of the discharge tube is connected to the discharge unit.

14. The cap device according to claim 13, wherein the discharge unit further includes a valve which is connected to the discharge tube and the pump.

15. The cap device according to claim 14, wherein the other end of the discharge tube is connected to the valve.

16. The cap device according to claim 1, wherein the discharge tube is drawn so that the discharge tube includes a bent portion.

17. A liquid jetting apparatus which jets two kinds of liquids, comprising:

a jetting head including a jetting surface on which a first nozzle and a second nozzle through which the two types of liquids are jetted, respectively, are formed; and the cap device as defined in claim 1.

18. The liquid jetting apparatus according to claim 17, wherein the cap unit includes a cap holder and a cap member, wherein the first and second nozzles include a plurality of first nozzles and a plurality of second nozzles, respectively, wherein the number of the first nozzles is greater than that of the second nozzles, the cap member further includes a partition plate, which is provided to project from the bottom wall portion toward the jetting surface side, and which is configured to partition the inner space into a first inner space facing the first nozzles and a second inner space facing the second nozzles under a condition that the lip comes into close contact with the jetting surface, wherein the discharge tube includes:

a flexible first discharge tube of which one end is connected to the cap holder and which is configured to communicate with the first inner space of the cap member to discharge a liquid in the first inner space; and a flexible second discharge tube of which one end is connected to the cap holder and which is configured to communicate with the second inner space of the cap member to discharge a liquid in the second inner space, wherein the cap device further includes a discharge unit to which the other ends of the first discharge tube and the second discharge tube are connected, and which is configured to suck the first and second inner spaces of the cap member to discharge the liquid in the first and second inner spaces, wherein the first discharge tube is longer than the second discharge tube and includes more portions fixed by the fixing mechanism than the second discharge tube, and wherein the fixing mechanism is configured to fix the first discharge tube at a portion of the first discharge tube that is farther away from the cap holder than a portion of the second discharge tube at which the fixing mechanism is configured to fix the second discharge tube.

* * * * *